US009033857B2

(12) United States Patent
Basily et al.

(10) Patent No.: US 9,033,857 B2
(45) Date of Patent: May 19, 2015

(54) APPARATUS AND METHOD FOR CONTINUOUS MICROFOLDING OF SHEET MATERIALS

(75) Inventors: Basily B. Basily, Piscataway, NJ (US); Elsayed A. Elsayed, East Brunswick, NJ (US)

(73) Assignee: RUTGERS, THE STATE UNIVERSITY OF NEW JERSEY, New Bruswick, NJ (US)

( * ) Notice: Subject to any disclaimer, the term of this patent is extended or adjusted under 35 U.S.C. 154(b) by 387 days.

(21) Appl. No.: 12/310,784

(22) PCT Filed: Aug. 27, 2007

(86) PCT No.: PCT/US2007/018799

§ 371 (c)(1),
(2), (4) Date: Mar. 6, 2009

(87) PCT Pub. No.: WO2008/033211

PCT Pub. Date: Mar. 20, 2008

(65) Prior Publication Data

US 2009/0325772 A1 Dec. 31, 2009

Related U.S. Application Data

(63) Continuation of application No. 11/518,642, filed on Sep. 11, 2006, now Pat. No. 7,758,487.

(51) Int. Cl.

| | |
|---|---|
| ***B31F 1/22*** | (2006.01) |
| ***B21D 13/04*** | (2006.01) |
| ***B31D 3/02*** | (2006.01) |
| ***B31F 1/00*** | (2006.01) |

(52) U.S. Cl.

CPC ... *B31D 3/02* (2013.01); *B31F 1/22* (2013.01); *B31F 1/0009* (2013.01); *B31F 1/0019* (2013.01); *B21D 13/045* (2013.01)

(58) Field of Classification Search

CPC ..... B21D 13/045; B31F 1/0019; B31F 1/22; B31F 1/0009

USPC ..... 493/356, 357, 358, 359, 360, 424, 432, 493/435, 442, 380, 381, 463; 72/179, 180, 72/181, 182; 156/166, 176, 200, 205, 208, 156/210

See application file for complete search history.

(56) References Cited

U.S. PATENT DOCUMENTS

| | | | |
|---|---|---|---|
| 1,485,917 A | 3/1924 | Harter | |
| 1,766,743 A | 6/1930 | Freeze | |
| RE18,760 E | 3/1933 | Yoder | |

(Continued)

FOREIGN PATENT DOCUMENTS

| | | | |
|---|---|---|---|
| EP | 0 318 497 | 11/1991 | |
| EP | 0 261 140 | 7/1992 | |
| GB | 191419056 A * | 0/1915 | ..... B31F 1/22 |

*Primary Examiner* — Stephen F Gerrity

(74) *Attorney, Agent, or Firm* — Niels Haun; Dann Dorfman Herrell & Skillman, PC

(57) ABSTRACT

A machine (10) and method for the continuous folding of sheet material (15) into difference three-dimensional patterns is featured. The innovative machine and method folds sheet material by force converging the sheet to a final stage that imparts a final fold or pattern. Unique programming allows for the change of convergence sequencing and change of materials. A plain die fold multiplier is placed before the final stage to double the number of folds in the sheet material and halve the height thereof.

24 Claims, 10 Drawing Sheets

(56) References Cited

U.S. PATENT DOCUMENTS

| | | | | | |
|---|---|---|---|---|---|
| 2,901,951 | A | | 9/1959 | Hochfeld | |
| 2,960,145 | A | * | 11/1960 | Ruegenberg | 264/286 |
| 3,251,211 | A | | 5/1966 | Harris | |
| 3,988,917 | A | | 11/1976 | Mykolenko | |
| 4,012,932 | A | | 3/1977 | Gewiss | |
| 4,411,146 | A | | 10/1983 | Sulasaari et al. | |
| 5,028,474 | A | | 7/1991 | Czaplicki | |
| 5,107,695 | A | | 4/1992 | Vandenbroucke | |
| 5,185,052 | A | | 2/1993 | Chappell et al. | |
| 5,664,451 | A | | 9/1997 | Schultz | |
| 5,947,885 | A | | 9/1999 | Paterson | |
| 5,983,692 | A | | 11/1999 | Bruck | |
| 6,209,375 | B1 | | 4/2001 | Kurose | |
| 6,289,707 | B1 | | 9/2001 | Saarenko | |
| 7,115,089 | B2 | * | 10/2006 | Basily et al. | 493/463 |
| 7,691,045 | B2 | * | 4/2010 | Basily et al. | 493/435 |
| 7,758,487 | B2 | * | 7/2010 | Elsayed et al. | 493/435 |
| 7,963,899 | B2 | * | 6/2011 | Papsdorf et al. | 493/463 |
| 8,475,350 | B2 | * | 7/2013 | Basily et al. | 493/463 |

* cited by examiner

APPARATUS AND METHOD FOR CONTINUOUS MICROFOLDING OF SHEET MATERIALS

RELATED PATENT AND APPLICATIONS

This Application is related to U.S. application Ser. No. 11/265,571 filed 2 Nov. 2005, now U.S. Pat. No. 7,691,045, and Ser. No. 11/518,642 filed 11 Sep. 2006, now U.S. Pat. No. 7,758,487, and to U.S. Pat. No. 7,115,089, each having the same assignee herewith. Also, this Application takes priority from PCT/US2007/018799 filed 27 Aug. 2007, and is a Continuation in Part Application from U.S. application Ser. No. 11/518,642, now U.S. Pat. No. 7,758,487. The teachings of both the co-pending Applications and Patents are incorporated by reference herein to the extent they do not conflict herewith.

FIELD OF THE INVENTION

The present invention relates to the folding of sheet materials and, more particularly, to the continuous folding of different types of sheet materials into a multiplicity of predetermined, three-dimensional structural patterns having a desired number of folds and fold heights.

BACKGROUND OF THE INVENTION

Folded materials are useful in packaging technology, sandwich structures, floor boards, car bumpers and other applications where requirements pertaining to shock, vibration, energy absorption, and/or a high strength-to-weight ratio including volume reduction must be met.

Continuous folding machines should have versatility, flexibility, and high production rates. Additionally, a machine that can additionally accomplish folding in an inexpensive manner is most rare.

SUMMARY OF THE INVENTION

In accordance with the present invention, various inventive embodiments for a machine and method for the continuous folding of sheet material into different three-dimensional patterns is disclosed.

One objective of the present inventive machine is to provide the folding of a wide range of materials over a range of desired fold configurations, and to fold such material over a wide range of sizes.

Another objective of the invention is to provide a machine with the ability to fold different types of sheet materials, as opposed to mere metal or paper, thereby providing a cost saving, because users need invest in only one machine.

Another objective is to provide a machine that can generate patterns with extensive geometric variations within the same family of patterns. The generated patterns can then be used in many applications such as cores for sandwiched structures, pallets, bridge decks, floor decks, and packaging applications.

The invention accomplishes all of the above objectives by having both a unique structure and unique programming. The programming allows for the change of the folding sequence, so that different patterns can be produced. The programming also allows for a selective change of materials.

The present inventive machine can also be programmed to provide microfolding stations each of which increases the number of folds while reducing the fold height, whereby if the number of folds are doubled, the fold height is reduced by one-half, for example.

In a general overview, the inventive machine causes the material to funnel towards an end section, which imparts the final folds or pattern. The funnel process can be thought of as a method of force convergence, or continuous-positioning of the material towards the final stage of the machine. The material is then finally folded in the desired pattern at the final stage.

The innovative machine folds sheet material, including paper, biodegradable material, composites and plastics, enables a flat sheet of material to be fed through a series of rollers or dies (the number of which is a function of final product width) that pre-fold the material until it reaches the last set of rollers or dies. The final fold pattern is implemented by having the pattern geometry negatively engraved on these rollers. The direction of the engraved folding pattern on the last set of rollers can be made longitudinal or perpendicular to the roller axis (or at any desirable angle in between), resulting in a longitudinal, angular or cross-folded sheet. Further, the last set of rollers can be made from different materials (metals, PVC, . . . ) or combinations of two different materials such as rubber on metal (one roller from rubber and the other from metal to create sharp increases in the folded pattern).

The material is fed between the first set of rollers or dies, which makes a central single fold in the middle of the material. The material then advances to a second set of rollers or dies, that makes two extra outer folds, one on each side of the first fold. The material then advances to a third set of rollers or dies, making two additional outer folds. This process continues at the sequenced sets of rollers or dies until the desired number of folds in the rolling direction is reached. In one embodiment of the invention a microfold multiplier having a plain (or circular) die configuration is inserted between a last roller or die for providing longitudinal folding and a final cross folding roller, for microfolding the sheet material before it enters the final roller.

At the last set of rollers or dies, the material is rolled between two rollers or dies having the fold patterns engraved/machined on their surfaces to produce the final pattern of the folded sheet. No additional folds are made at the last set of rollers or dies. The design, manufacture, and integration of the last set of rollers or dies is flexible enough that other patterns can easily be produced in a short period of time and with minimum machine setting of both pre- and final folding stages. The above procedures are applicable to any other method for folding based on the principle of series 1, 3, 5, 7 . . . , until the desired width of material is achieved. At this stage the material is then fed through the fold multiplier die to reduce the height of the pattern by 50% and double the number of folds in the same material width. This includes flat dies or frames (or roller dies) with grooves that follow this sequence.

The folded sheet, upon leaving the inventive machine, can be compressed further to any desired compaction ratio and/or laminated between overlying and underlying sheets of material to produce structures and packaging material with specific characteristics. The design flexibility of the machine allows folding patterns of different materials and different thicknesses and/or with different mechanical properties.

Specifically, the invention performs folding in the mathematical series 1, 3, 5, 7, . . . , where the numerals are related to the number of tessellations on the surface of each set of rollers or dies at each stage of the initial folding process. This specific sequencing, creating two new longitudinal tessellations on each successive set of rollers according to the mathematical series 1, 3, 5, 7, . . . totally eliminates the typical material slitting (or shredding) phenomenon, which occurs if all tessellation is performed in one set of rollers or dies, causing material to be cogged in, and stretch to conform to, roll or die profile. This innovative technique eliminates this slitting (or shredding) phenomena by subjecting the sheet material to only two predetermined transverse friction forces: one on each edge of the sheet. Material on the edges has access to flow in from the sides to form the next two extra tessellations without undue restriction.

The innovative sequential tessellation technique enables sheet materials to be effectively folded with minimum power requirements, and without sheet slitting and/or stretching. The innovative use of one or more microfolding fold multiplier plain dies before a final cross folding roller reduces the length of the machine compared to not using fold multiplier roller stations.

This technology introduces new and highly economical methods of producing lightweight cores, structures, and packages that outperform most of the existing comparative structures and their methods of production. The material that is formed has many applications ranging from the design of diesel filters, to aviator crash helmets, to high-speed lighters, to airdrop cushioning systems, to biodegradable packaging materials and to lightweight floor decks, among others. The technology can produce structures of versatile shapes, single and multiple layers, and different patterns created from different materials, geometries and dimensions.

The inventive machine has produced packages that have outperformed honeycomb packages, the current industry and government standard. The produced cushioning packaging pads are capable of absorbing significantly higher energy per unit volume when compared with honeycomb packaging structures.

All types of 3-D geometrical patterns can be formed from a flat sheet of material without stretching, and then selecting such a pattern to be folded. Specifically, to preserve the folding intrinsic geometry, each vertex in a faceted surface must have all the angles meet at the point from adjacent faces to total 360 degrees. This 360-degree total of angles is required for the vertex to unfold and lay flat in the plane, thereby eliminating stretching.

A mathematical theory of the folding geometry of this invention was been developed by Daniel Kling, and can be studied in greater detail in U.S. Pat. No. 6,935,997. This theory facilitates the pattern selection process for use with the inventive machine. A pattern can be chosen via this mathematical theory based on different criteria, such as geometry, strength, or density, based on the desired parameters of the final product.

Other existing technologies for forming sheet materials are not at all similar to the inventive technology. For example, known forming machines use dies of flat and rigid tessellations to stretch the sheet material to form identical shapes to those of the pattern to be produced in the final folded shape of this technology. This technology and other types of technologies result in non-uniform change in both sheet thickness and material properties, due to the nature of the forming operation. This is opposed to the current invention's folding operation that does not stretch or adversely change any of the existing material physical or mechanical properties since it creates the folded pattern by only bending the sheet material along the edges of the tessellations in the form of plastic hinges.

An advantage of the present invention is its ability to fold sheet material into a continuous intricate faceted structure.

Another advantage of the present invention is that it is a versatile, flexible, and inexpensive machine that performs various folding operations.

Another advantage of the present invention is its ability to fold sheet material while preserving its intrinsic geometry without stretching it.

Another advantage of the present invention is its ability to fold sheet material with minimum energy and load requirement, due to the nature of the folding mechanism being of very localized deformed zones of plastic hinges formed on tessellation edges.

Another objective and advantage of the present inventive sheet material folding machine is the use of one or more plain (or roller) die configured fold multipliers to minimize the length and cost of the folding machine.

BRIEF DESCRIPTION OF THE DRAWINGS

The present invention is described below with reference to the accompanying drawings, in which like items are identified by the same reference designation, in which.

DETAILED DESCRIPTION OF THE INVENTION

Generally speaking, a machine for continuous folding of sheet materials is featured. The machine comprises a plurality of rollers or dies, each with a different amount of raised portions (related to the number of tessellations) for creating folds in the material traveling through the machine.

Figure 1:
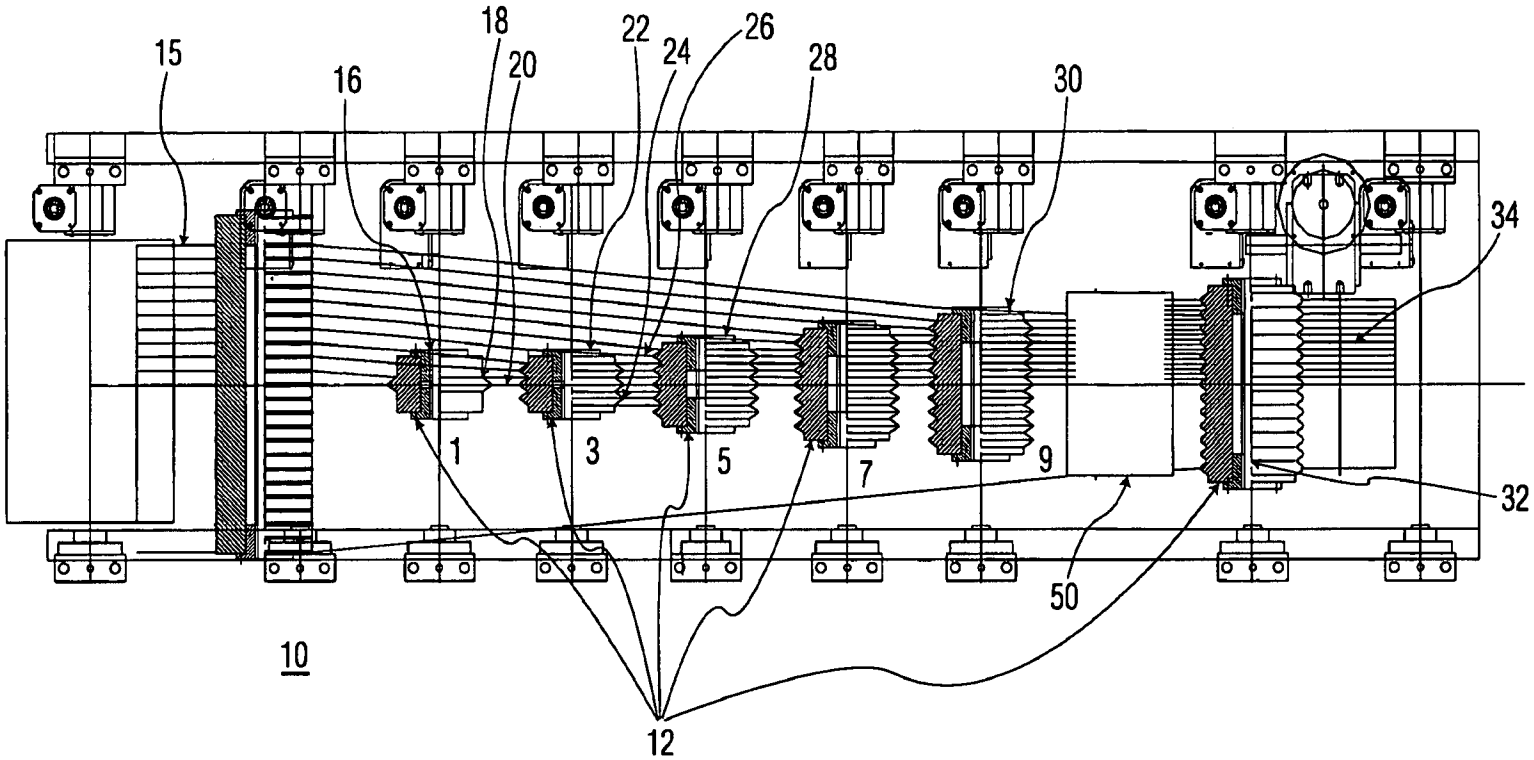
FIG. 1 illustrates a top view of the machine of this invention for continuous folding of sheet materials fitted with the fold multiplier.
Figure 2:
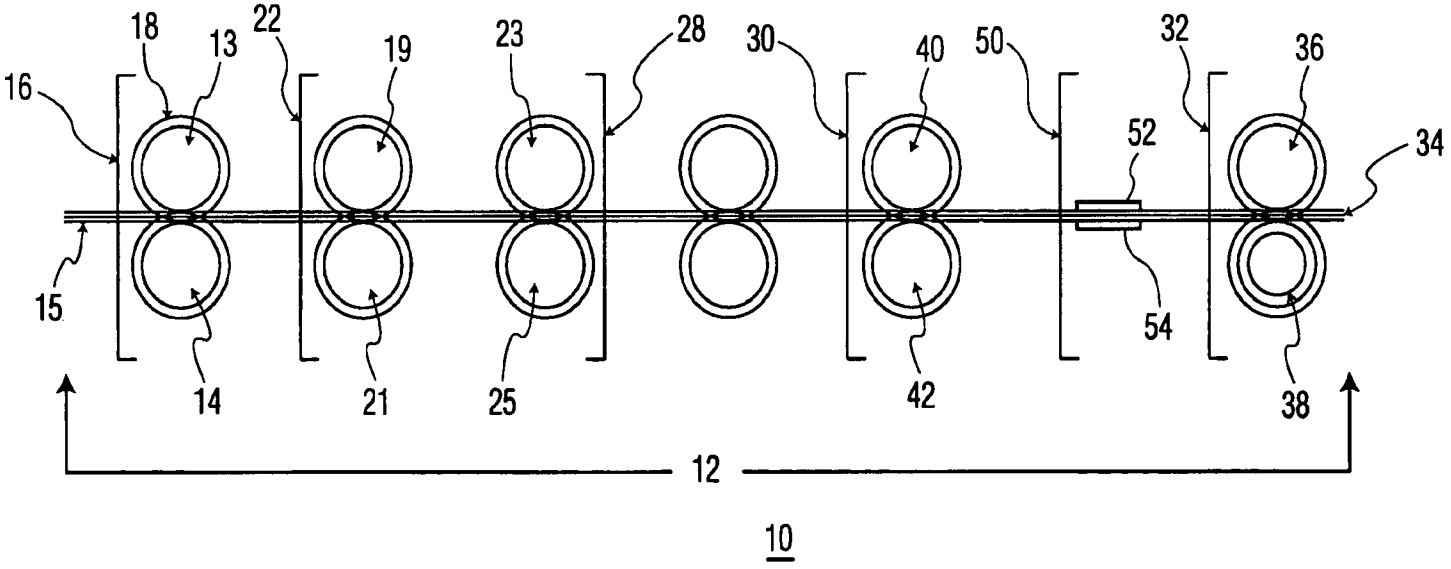
FIG. 2 illustrates a side view of the machine for continuous folding of sheet materials fitted with the fold multiplier.
Figure 3:
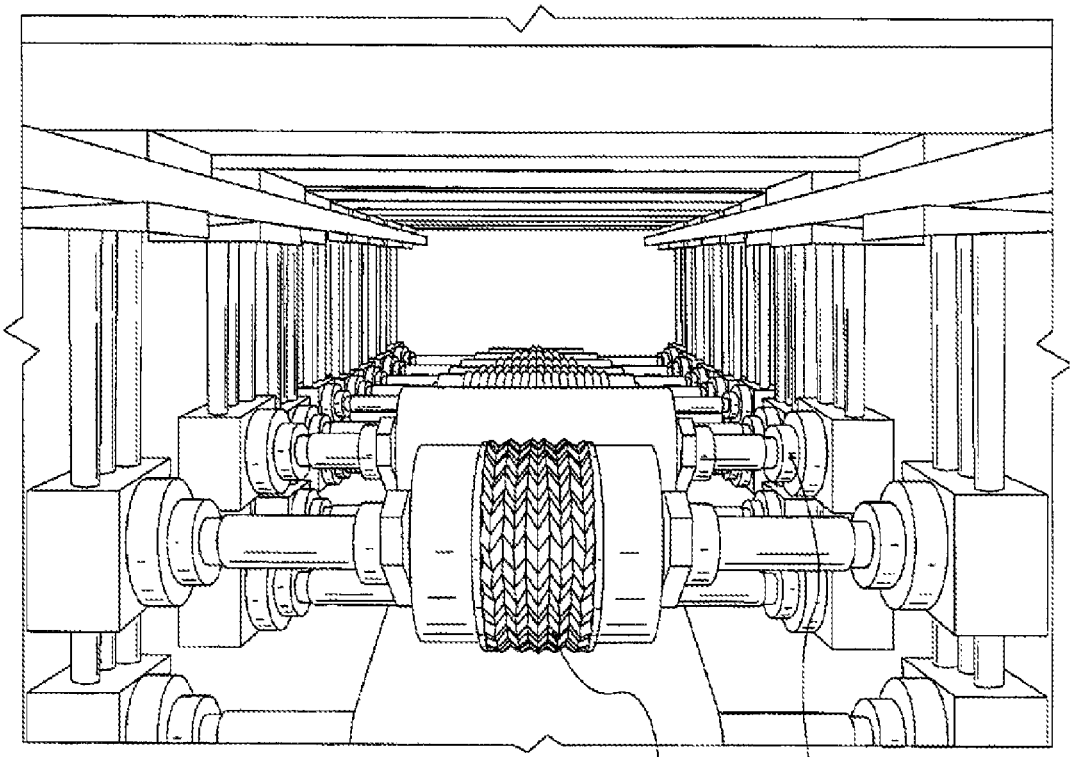
FIG. 3 illustrates a front view of the machine for continuous folding of sheet materials.

Now referring to FIGS. 1 to 3, the machine for continuous folding of this invention, generally referred to as number 10, is shown. The machine for continuous folding 10 comprises a plurality of sets of rollers or dies 12. A set of rollers 12 comprises upper rollers and lower rollers, shown in FIG. 2. Each set of rollers, or dies 12 has a number of tessellations 18 for folding sheet material 15, also shown in FIG. 3, where each tessellation is a series of raised shapes (sometimes "V" shaped) that span the circumference of the roller.

The sheet material 15 is fed through the first proximal set of rollers or dies 16. Each roller or die 13, 14 of the first proximal set of rollers or dies 16 has one tessellation 18. This tessellation 18 makes a single fold 20 in the sheet material 15.

Each roller or die 19, 21 of the second set of rollers or dies 22 has three tessellations for making an additional two folds in the sheet material 15. The single fold 20 produced by the first proximal set of rollers or dies 16 proceeds through the center tessellation of the second set of rollers or dies 22 where it maintains its shape. Two new folds 24, 26 are created by the outside tessellations of the second set of rollers or dies 22.

Each roller or die 23, 25 of the third set of rollers or dies 28 has five tessellations, two more tessellations 18 than each roller or die 19, 21 in the previous second set of rollers or dies 22. This pattern of two additional tessellations 18 per roller or die continues from the first set of rollers or dies 16 to the penultimate set of rollers or dies, shown in this embodiment at numeral 30. In this example, a plain die 50 configured for multiplying the number of folds from the set of rollers 30 by a factor of two, and reducing the height of the folds by one-half in this example, is installed between the two sets of rollers 30 and 32. As will be described in greater detail below, the plain die includes an upper plate 52, and a lower plate 54. Each roller or die 36, 38 of the final set of rollers or dies 32 has the same number of tessellations 18 as the number of folds in the sheet material exiting from the plain die 50, in this example. The final fold pattern 34 is implemented by having the pattern geometry negatively engraved on the last set of rollers or dies 32. Further, the last set of rollers or dies 32 can be made of rubber to create sharp creases in the sheet material 15.

Six sets of rollers and one plain die are depicted in FIG. 1, but the inventive machine for continuous folding 10 can have any number of sets of rollers or dies depending on the desired width and height of the final folded structure. The number of tessellations 18 on each roller or die is determined from the mathematical series 1, 3, 5, 7, . . . , where each roller or die 13, 14 in the first proximal set of rollers or dies 16 has one tessellation 18, and each roller or die 19, 21 in the second set of rollers or dies 22 has three tessellations 18, etc. However, through use of a plain die 50, as configured in this example for doubling the number of folds while reducing the height of the folds in half, is not meant to be limiting.

The final material 34 is in the desired form once it leaves the last set of rollers or dies 32. To fold a different pattern on the sheet material 15, the tessellations 18 on all of the rollers or dies can be easily changed.

The design of the machine for continuous folding 10 allows any length of material to be folded. The sheet material 15 starts out at its widest width at the first set of rollers or dies 16 and becomes narrower at each successive set of rollers or dies, as the number of tessellations 18 increases (FIG. 1). This design allows for any length of material to be folded without incurring damage (e.g., stretching) to the sheet material 15.

The present inventors recognized that prior art folding machines utilizing a large number of folding rollers are excessively long, and many times are impractical for use, in applications where a large number of folds are required in the sheet material. In many such instances, the length of the machine required for providing a large number of folds is excessive. Accordingly, the present inventors conceived a fold multiplier 50 provided by a plain die configuration 52, 54, as shown in the example in FIGS. 4A, 4B, 5, 6, 8A, 8B, 8C, 8D, 9A, 9B, 9C, 9D, and 11 through 14, which is described in detail below, whereby the plain die configuration provides for reducing the length of the folding machines while greatly increasing the number of folds in the sheet material, as opposed to using sets of rollers for accomplishing the same number of folds. In the plain die configuration 52, 54 example given below, the number of folds are doubled. However, the configuration of the plain die 50 can be modified to provide less than or greater than a doubling of the number of folds. Also, a plurality of plain die configurations can be utilized to increase the number of folds in the sheet material to a desired amount. The inventors expect that the fold multiplier provided by their inventive plain die configuration 52, 54 should be able to reduce the length of folding machines in which the dies are utilized according to the mathematical series: ½, ¼, ⅛, 1/16 . . . depending on the final height of the fold when compared with the initial height. For example, in a particular folding machine a one inch high fold is provided from the last set of fold rollers, a die configuration 52, 54 of the embodiment of the invention described below is utilized, after passing through the die 50, the number of folds of the material will be doubled, while the height of the folds will be reduced to ½ inch high. In such an instance, the associated folding machine will likely be reduced in length by a factor of ½, whereas if dies are utilized for quadrupling the number of folds while reducing the fold height from 1 inch to ¼ inch, it is expected that the folding machine length will be $\frac{1}{4}^{th}$ that of such a machine utilizing additional rollers for obtaining the same number of folds and fold height.

Figure 4A:
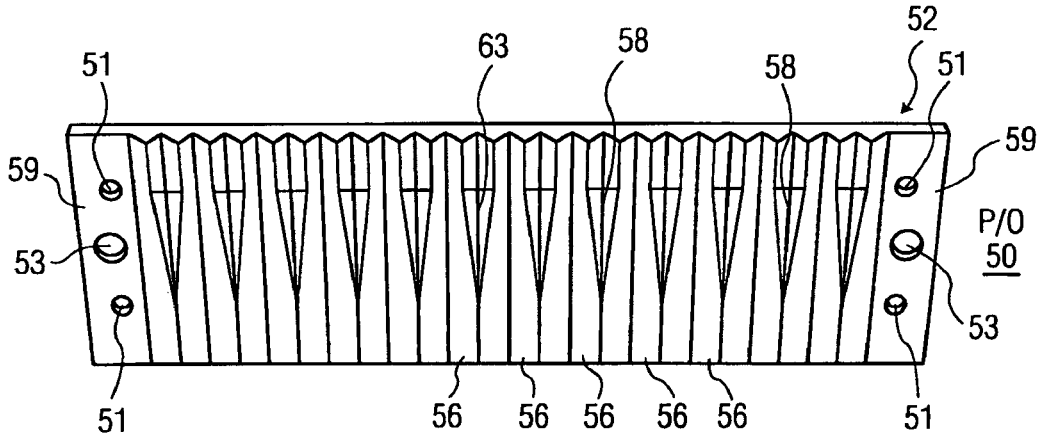
FIGS. 4A and 4B show top and bottom sections, respectively, of a plain die configuration, for a folding multiplier for one embodiment of the invention.
Figure 4B:
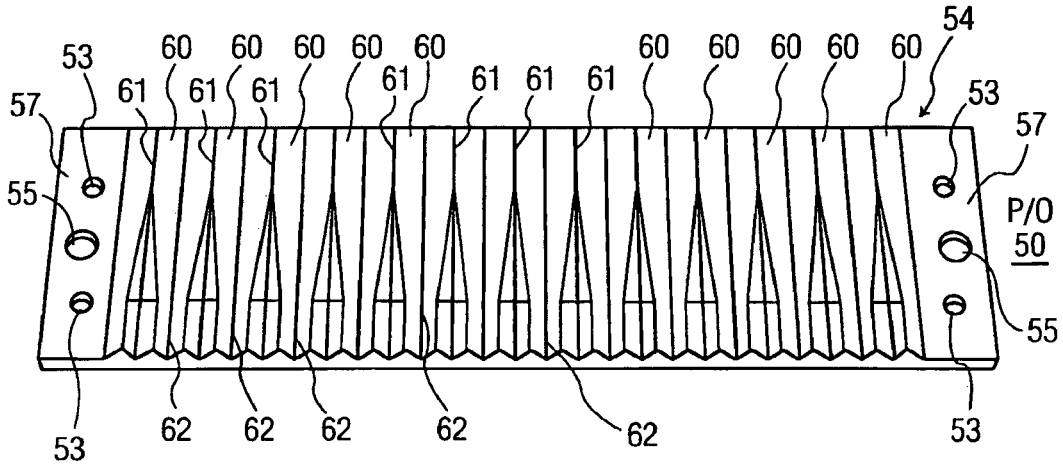
Figure 5:
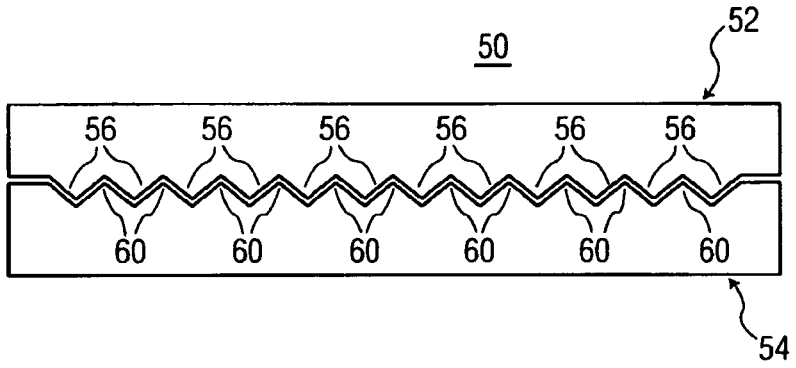
FIG. 5 shows a front elevational view of a the die of FIGS. 4A and 4B.
Figure 6:
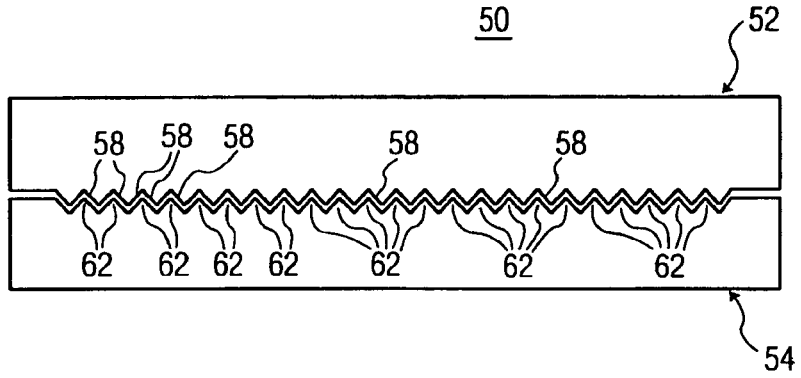
FIG. 6 shows a back elevational view of the die of FIGS. 4A and 4B.

An example of a configuration for the die 50 shown in FIGS. 1 and 2 will now be described. As shown in FIG. 2, the die 50 includes a top section 52, and a bottom section 54 between which the sheet material passes, for doubling the number of folds and decreasing the fold height by a factor of one-half, in this example. FIG. 4A shows a pictorial view of a working surface of the top section 52 of die 50. As shown, the die includes opposing mounting sides 59, each of which includes mounting holes 51 and 53, as shown. Between the side portions 59 and from the front of die section 52, a plurality of parallel and successive triangular projections 56 are formed. Receding from about one third of the way from the front to the back surface of the die section 52, the triangular projections 56 from triangular shaped grooves 58 cut into respective central portions as shown, with the triangular portions of the grooves 58 having diverging side portions that merge into parallel side portions proximate the top section 52 of the die 50. The bottom die section 54 of die 50 is shown in FIG. 4B. Bottom die section 54 includes opposing side mounting portions 57 each having mounting holes 53 and 55, as shown. Between these mounting sections or portions 57, the interior face of section 54 is configured to include beginning from a front portion thereof a plurality of triangular-shaped projections 60 each for a short distance have parallel side portions that flow into centrally located converging side portions, followed by parallel side portions for triangular projections 62 that terminate at the back of the die section 54, as shown. Note that both the top die section 52 and bottom die section 54 each consist of a single piece of material, such as for example Teflon®, PVC, or highly polished aluminum. Other suitable materials with a low coefficient of friction can be used. The top die section 52 is mated with the bottom die section 54, triangular groove sections 58 formed between the successive triangular projections 56 of the top die section 52 receive the triangular projections 60 of the bottom die section 54. Also, the successive spaced-apart triangular grooves 58 of the die section 52 receive the triangular projections 62 of the lower die section 54, in this example. FIG. 5 shows a front elevational view of the die section 54 mounted upon the bottom die section 54. Similarly, FIG. 6 shows the back elevational view of the top die section 52 mounted on the bottom die section 54. In this example, the sheet material enters the end of the die 50 with eleven and one-half folds, and exits from the back of the die 50 with 23 folds or double the number of folds, but with half the height of the initial folds.

Figure 7:
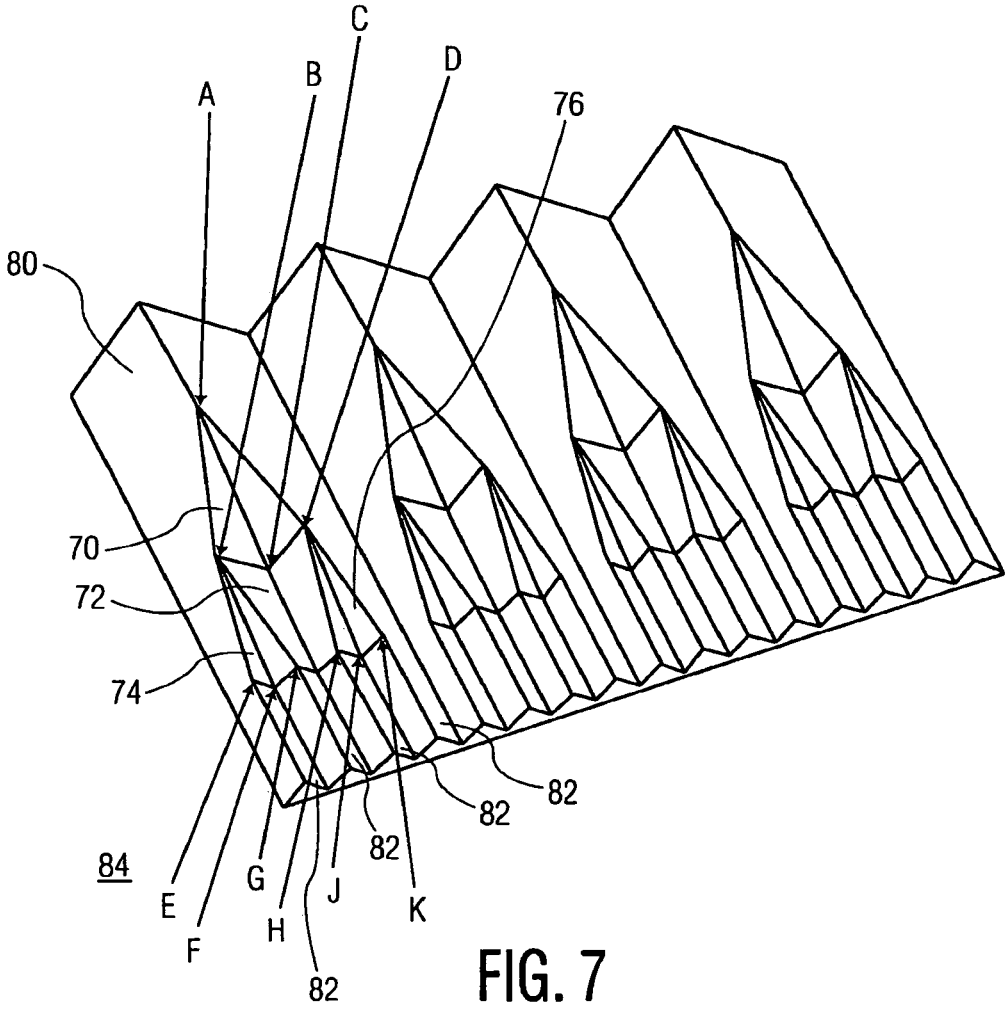
FIG. 7 is a pictorial view of a portion of a reconfigured bottom die of FIG. 4B, for illustrating operation of another embodiment of the plain die folding multiplier.

The configuration of the triangular projections 56, 62 and grooves 58, 61 in the top die section 52 and bottom die section 54 respectively, actually can be made somewhat more complicated than previously described. Specifically, FIG. 7 shows a detailed pictorial view of the triangular grooves and projections for a portion of a reconfigured bottom die section referenced as 84, beginning initially from the front thereof, and proceeding toward the back end thereof, initially a plurality of successive and parallel triangular projections 80 are encountered. About a fourth of the way proceeding from the front to the back end of the die section 84, the triangular groove 70 with diverging side portions formed there into about the center of the associated triangular projection 80. Triangular groove 70 is followed by continuing triangular groove 72 that has converging side portions are terminated by one quarter of the distance to the back end of the die section 84, leading to a fold of ¼ the initial height. Triangular relatively smaller groove sections 74 and 76 each have diverging side portions that are formed immediately adjacent to the right and left hand converging side portions of the triangular groove 72, respectively, as shown. The triangular grooves 72, 74, and 76, each terminate about one quarter of the way from the back end of the lower die section 84, in a manner forming the successive juxtaposed and parallel triangular projections 82, as previously described. Similarly, the mating top die section (not shown) includes appropriately configured triangular grooves for receiving the triangular projections 60, and triangular projections 62. Also, the top die section (not shown) also includes appropriately configured triangular projections that are received by the triangular grooves 70, 72, 74, and 76 of lower die section 54.

The operation of the plain die folding multiplier 50 will now be described with reference to FIGS. 4A and 4B. First, assume that the sheet material 15 has passed through the plurality of sets of rollers 12, and folded using the arithmetic series: 1, 3, 5, 7, . . . until a minimum acceptable fold height of a number of folds has been produced. In this example, the longitudinal folded material 15 is then fed through the fold multiplier 50. The sheet material 15 exits from the fold die 50 with twice as many folds, with each fold having half the initial height that it previously had when entering the plain die 50. Note that a plurality of successive plain dies 50 can be installed in the machine 10, in this example, for repeating the doubling of the number of folds and halving of the fold height until a desired fold height is achieved, for example.

With further reference to FIG. 7, an example of operation of the plain die folding multiplier 50 for another embodiment of the invention will be immediately described. Assume that the plurality of the sets of rollers 12 of folding machine 10 are used to fold the sheet material to a height of 0.5 inch in the longitudinal direction. The sheet material 15 next enters the plain die fold multiplier 50, the top edges of the folded sheet 15 are forced to deflect downward at point A, thereby forming two triangular segments ABC, and ADC, respectively, which results in reducing the fold height by ½ while the number of folds is doubled. As the sheet material 15 advances from die 50, the points B and D present the lower apexes, in this example, leaving the sheet material 15 to be forced again to be downwardly deflected to form two new sets of two triangular segments BEF, BGF, respectively, fanning from apex B. Another set of triangles DHJ, DKJ, respectively, are formed fanning from apex D. The entering fold at apex B and apex D is again being reduced to half its height and transformed into two identical smaller folds. The aforesaid process can be repeated as required to obtain a desired final fold height and/or a specific number of folds per inch in the sheet material 15. Theoretically, there is no limit on the number of stages in the aforesaid fold multiplier process, and the actual limit is set by the combined effect of the coefficient of friction between the sheet material and the die material and sheet material properties.

With reference to the example of the fold multiplier plain die 50 of FIGS. 4A and 4B, it utilizes the configuration used for the top section 52, and bottom die section 54, for doubling the number of folds and reducing the height by one half for sheet material 15 passed therethrough in an engineering prototype. The fold multiplier plain die configuration of FIG. 7 is more complicated than that of FIGS. 4A and 4B, in that three stages of double folding and halving of height are provided.

The fold multiplier plain die 50 of FIGS. 4A, 4B, 5, and 6 were used by the inventors in an engineering prototype for doubling the number of folds from a sheet material 15 while reducing the height of the fold in half. FIGS. 8A through 14 show further details of the plain die multiplier 50 used in an engineering prototype.

Figure 8A:
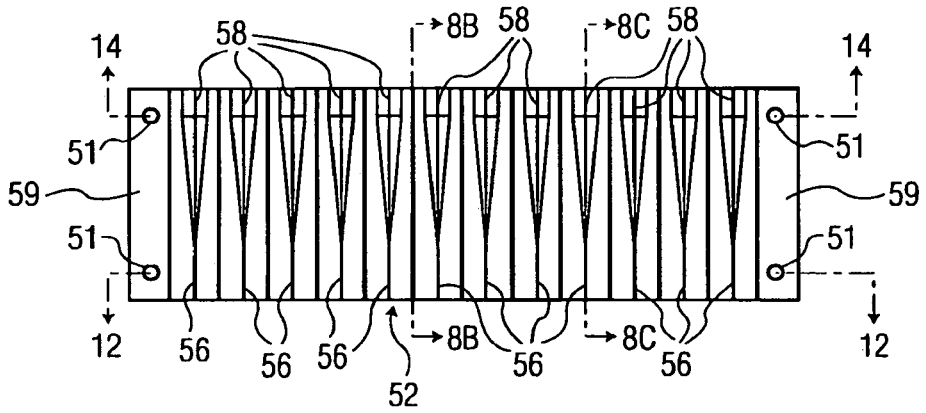
FIG. 8A is a top plan view of a top die section of FIG. 4A.
Figure 8B:
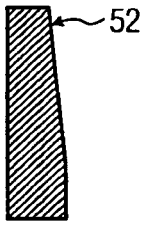
FIG. 8B is a cross sectional view taken along 8B-8B of FIG. 8A.
Figure 8C:
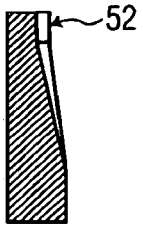
FIG. 8C is a cross sectional view taken along 8C-8C of FIG. 8A.
Figure 8D:
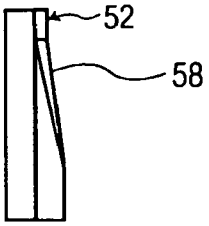
FIG. 8D is a left-side view of FIG. 8A, the right-side view being a mirror image thereof.
Figure 9A:
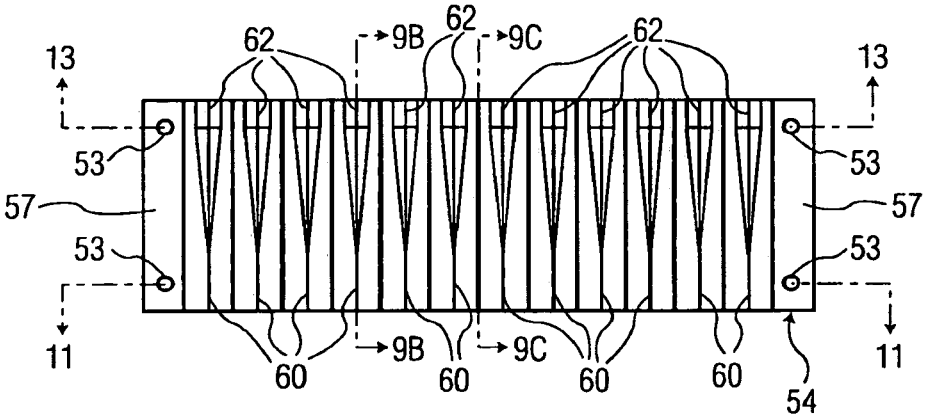
FIG. 9A is a top plan view of the bottom die section of FIG. 4B.
Figure 9B:
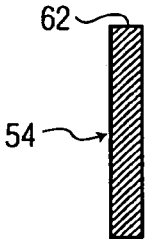
FIG. 9B is a cross sectional view taken along 9B-9B of FIG. 9A.
Figure 9C:
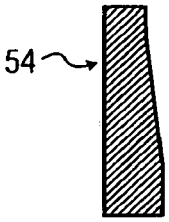
FIG. 9C is a cross sectional view taken along 9C-9C of FIG. 9A.
Figure 9D:
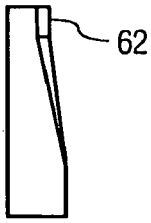
FIG. 9D is a left-side view of FIG. 9A, the right side view being a mirror image thereof.
Figure 10:
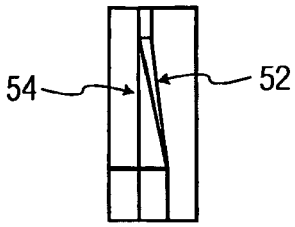
FIG. 10 shows a side view of mating top and bottom die sections of FIGS. 5 and 6.
Figure 11:
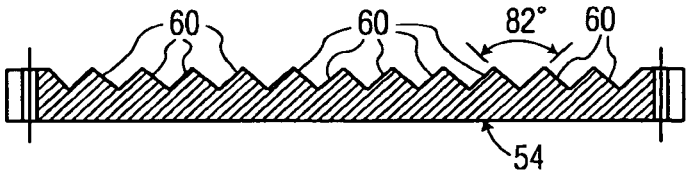
FIG. 11 is a front elevational view of the bottom die section of FIG. 4B.
Figure 12:
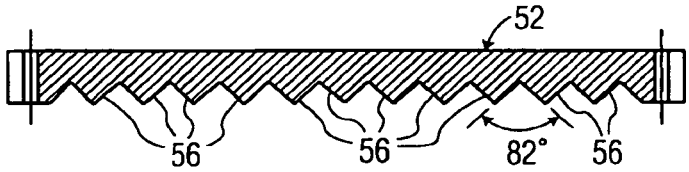
FIG. 12 is a front elevational view of the top die section of FIG. 4A.
Figure 13:
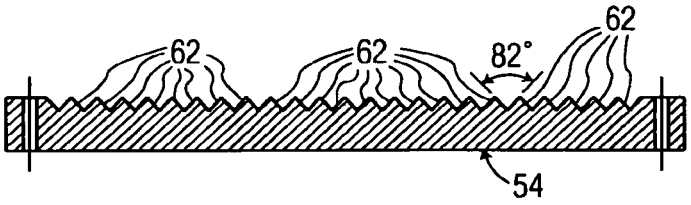
FIG. 13 is a back elevational view of the bottom die section of FIG. 4B.
Figure 14:
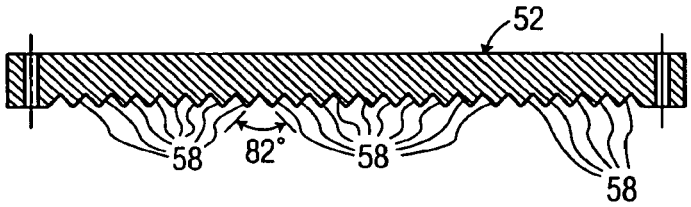
FIG. 14 is a back elevational view of the top die section of FIG. 4A.

FIGS. 8A and 9A show the top die section 52, and bottom die section 54, respectively, as previously described. Note that the dimensions thereof can be varied for providing a die 50 to receive fold material having folds of a particular height. Also, the length of the die section 52 and 54 can be varied to accommodate a given number of folds of the sheet material to be processed by the die 50.

Although various embodiments of the present invention are shown and described, they are not meant to be limiting. Accordingly, the present disclosure covers all changes and modifications that would be apparent to one of skill in the art which do not constitute departures from the true spirit and scope of this invention, and appended claims.

What is claimed is:

1. A method for passing a length of sheet material having x number of longitudinal folds, said folds having a height of y through a plain die fold multiplier for forming a desired number of longitudinal folds and/or fold height in said sheet material comprising the steps of:

forming a plain die fold multiplier comprising:

a first plate;

a second plate overlying said first plate, opposing top and bottom sections of said first and second plates, respectively, being configured to intermesh with one another in a substantially fixed manner permitting said sheet material to be continuously moved through said plain die fold multiplier, between a front end and a back end thereof;

a guide section proximate said front end for aligning and guiding a first set of longitudinal folds of said sheet material into said plain die fold multiplier; and a fold section for receiving said sheet material from said guide section said fold section being configured for further folding said sheet material to double the number of longitudinal folds to 2X while halving the height of said longitudinal fold to y/2;

entering said sheet material into said front end of said plain die fold multiplier for entry into said guide section, with said first set of longitudinal folds being nestled between intermeshing downwardly and upwardly projecting triangular guide members, respectively, formed in said guide section in said top and bottom overlying sections of said plain die fold multiplier; and moving said sheet material from said guide members into said fold section of said plain die fold multiplier, wherein said first set of longitudinal folds are passed between a pair of downwardly projecting adjacent triangular segments of said top section intermeshed with two adjacent triangular shaped depressions formed in said bottom section, whereby top edges of said longitudinal folds in said sheet material are forced downward into said two adjacent triangular shaped depressions, thereby causing said longitudinal original folds to be divided into two folds each having one-half the height of the associated original fold.

2. The method of claim 1, further including the step(s) of: successively repeating said moving step as said sheet material is moved through a plurality of said folding sections of said plain die fold multiplier until a desired number of folds and/or a desired fold height has been formed in said sheet material.

3. The method of claim 2, further including the step of: passing said sheet material through an exit region of said plain die fold multiplier, whereby each fold is guided between a downwardly projecting triangular guide member from said top section of said plain die fold multiplier intermeshed with an upwardly projecting triangular guide member from said bottom section.

4. The method of claim 1, further including the step of: passing said sheet material through an exit region of said plain die fold multiplier, whereby each fold is guided between a downwardly projecting triangular guide member from said top section of said plain die fold multiplier intermeshed with an upwardly projecting triangular guide member from said bottom section.

5. A plain die fold multiplier for receiving sheet material previously folded to have x number of longitudinal folds, where x=1, 2, 3, 4, . . . , and each longitudinal fold has a height y, said plain die fold multiplier comprising:

a first plate;

a second plate overlying said first plate, opposing sections of said respective first and second plates being configured to intermesh with one another in a substantially fixed manner permitting said sheet material to be continuously moved through said plain die fold multiplier between a front end and a back end thereof;

a guide section proximate said front end for aligning and guiding said longitudinal folds of said sheet material into said plain die fold multiplier; and a fold section for receiving said sheet material from said guide section, said fold section being configured for further folding said longitudinal folds in said sheet material to double the number of longitudinal folds to 2X, while halving the height of said longitudinal fold to y/2.

6. The plain die fold multiplier of claim 5, further including: another guide section for receiving said sheet material from said fold section for aligning and guiding each fold of sheet material as it passes through said plain die fold multiplier.

7. The plain die fold multiplier of claim 6, after said another guide section further including:

a plurality of n successive pairs of fold sections and guide sections, where n=2, 3, 4, 5 . . . , whereby each doubles the number of folds in the sheet material it receives to $2^n x$, while reducing the height of y each fold to $y/2^n$, said sheet material exiting the back end of said plain die fold multiplier from the last one of said guide sections.

8. The plain die fold multiplier of claim 5, wherein said guide section includes:

alternatively juxtaposed pluralities of triangular projections and troughs on opposing portions of said first and second plates configured to provide for the projections of each to intermesh with the troughs of the other.

9. The plain die fold multiplier of claim 8, wherein said fold section includes:

said first plate, following a top edge of each one of its said plurality of triangular projections of said guide section, including:

a first trough formed by adjacent first and second triangular walls sharing a common side following a top edge of an associated triangular projection of said guide section, for forming two adjacent triangular segments in an original fold of said sheet material, the sides of said first and second triangular depressions not being shared meeting to form independent first and second apexes; and said second plate, following an outermost edge of each one of its said plurality of triangular troughs of said guide section, including:

a first triangular projection for intermeshing with an opposing first trough of said first plate, for doubling the associated original fold of said sheet material and halving its height.

10. The plain die fold multiplier of claim 9, wherein said fold section further includes:

said first plate further including:

second and third troughs each formed by an adjacent pair of triangular wall portions sharing a common side, said second and third troughs being spaced apart;

said second plate further including:

second and third triangular projections spaced apart and immediately following opposing outer apexes of said first triangular projection, whereby said second and third triangular projections are configured for intermeshing with said second and third troughs of said first plate, respectively, the combination of said second projection and second trough, and third projection and third trough, each serving to double an associated fold and halve the height thereof, as said sheet material is moved therethrough.

11. A method for folding sheet material with tessellated patterns, comprising:

a) providing a plurality of sets of rollers, where each set of rollers is defined by a first roller and a second roller;

b) providing at least one tessellation disposed on each roller of the first set of rollers;

c) providing at least one tessellation disposed on each roller of the remainder of said plurality of sets of rollers, wherein each of said tessellations of said remainder of said sets of rollers makes one longitudinal fold in said sheet and wherein each roller of said remainder of said set of rollers, except for the last set of first and second rollers, has two more tessellations than each roller of a previous set of rollers;

d) moving said sheet material through said plurality of sets of rollers;

e) folding said sheet material with each tessellation on each roller of said sets of rollers forming one corresponding fold;

f) forming a plain die fold multiplier comprising:

a first plate;

a second plate overlying said first plate, opposing top and bottom sections of said first and second plates, respectively, being configured to intermesh with one another in a substantially fixed manner permitting said sheet material to be continuously moved through said plain die fold multiplier, between a front end and a back end thereof; a guide section proximate said front end for aligning and guiding said longitudinal folds of said sheet material into said plain die fold multiplier; and a fold section for receiving said sheet material from said guide section, said fold section being configured for further folding said sheet material to double the number of longitudinal folds to 2X, while halving the height of said longitudinal folds to y/2;

g) inserting said plain die fold multiplier immediately before said last set of first and second rollers for both increasing the number of folds in said sheet material by a multiple of $2^n$x, where x is the number of folds in said sheet material entering said plain die fold multiplier, and n=2, 3, 4, 5, . . . , and decreasing the fold height of each fold to y/$2^n$, where y is the height of the folds entering the plain die fold multiplier; and h) moving said sheet material from said plurality of sets of rollers through said plain die fold multiplier for increasing the number of longitudinal folds in said sheet material.

12. The method for folding sheet material in accordance with claim 11, wherein the last set of first and second rollers comprises elastic tessellations.

13. A machine for folding sheet material, comprising: a plurality of sets of rollers, each set of rollers being defined by a first roller and a second roller;

at least one tessellation disposed on each roller of the first set of rollers for making a single longitudinal fold in said sheet material;

at least one tessellation disposed on each roller of the remainder of said plurality of sets of rollers, where each of said tessellations of said remainder of said sets of rollers makes one longitudinal fold in said sheet; and wherein each roller of said remainder of said sets of rollers, except for the last set of first and second rollers has two more tessellations than each roller of a previous set of rollers; and a plain die fold multiplier located immediately before said last set of first and second rollers, for receiving sheet material as previously folded to have x number of longitudinal folds, . . . , and each longitudinal fold has a height y, said plain die fold multiplier including:

a first plate;

a second plate overlying said first plate, opposing sections of said respective first and second plates being configured to intermesh with one another in a substantially fixed manner permitting said sheet material to be continuously moved through said plain die fold multiplier, between a front end and a back end thereof;

a guide section proximate said front end for aligning and guiding each fold of said sheet material into said plain die fold multiplier; and a fold section for receiving said sheet material from said guide section, said fold section being configured for further folding said sheet material to double the number of longitudinal folds to 2x, while halving the height of said longitudinal folds to y/2.

14. The machine of claim 13, wherein said plain die fold multiplier further includes:

another guide section for receiving said sheet material from said fold section for aligning and guiding each fold of sheet material as it passes through said plain die fold multiplier.

15. The machine of claim 13, further including:

a plurality of n successive fold sections, where n= 2, 3, 4, 5 . . . , whereby each fold section doubles the number of folds in the sheet material, x being the number of folds in the originally received sheet material, and halves the height of each fold, y being the height of the folds in the originally received sheet material, the combination of said plurality of fold sections increasing the number of folds to $2^n$x and decreasing the height of the resulting folds to y/$2^n$.

16. The machine for folding sheet material in accordance with claim 13, wherein each roller of said last set of rollers has the same number of tessellations as each roller of the penultimate set of rollers.

17. The machine for folding sheet material in accordance with claim 13, wherein said single fold created by the tessellation on each roller of said first set of rollers advances through and is aligned with a center tessellation of each of remaining sets of rollers.

18. A machine for folding sheet material, comprising:

a plurality of sets of rollers, where each set of rollers is defined by a first roller and a second roller;

at least one tessellation disposed on each roller of each set of rollers for making a single longitudinal fold in said sheet material;

at least one tessellation disposed on each roller of the remainder of said set of rollers, where each said tessellation makes one fold in said sheet material;

a plain die fold multiplier positioned between the penultimate and last set of rollers, for receiving said sheet material having x number of longitudinal folds, where each longitudinal fold has a height y, said plain die fold multiplier including:

a first plate;

a second plate overlying said first plate, opposing sections of said respective first and second plates being configured to intermesh with one another in a substantially fixed manner permitting said sheet material to be continuously moved through said plain die fold multiplier between a front end and a back end thereof;

a guide section proximate said front end for aligning and guiding said longitudinal folds of said sheet material into said plain die fold multiplier; and a fold section for receiving said sheet material from said guide section, said fold section being configured for further folding said sheet material to double the number of longitudinal folds to 2x, while halving the height of said longitudinal folds to y/2.

19. The machine for folding sheet material in accordance with claim 18, wherein each roller of said remainder of said set of rollers, except for the last set of rollers, has two more tessellations than each roller of a previous set of rollers.

20. A method for folding sheet material with tessellated patterns, wherein said sheet material is placed between a first pair of rollers, each roller of said first pair of rollers having at least one tessellation, said method comprising the steps of:

(a) using said at least one tessellation to cause said sheet material to be folded;

(b) causing said sheet material to travel through remaining pairs of rollers, each of which has more than one tessellation;

(c) forming a plain die fold multiplier including:

a first plate:

a second plate overlying said first plate, opposing top and bottom sections of said first and second plates, respectively, being configured to intermesh with one another in a substantially fixed manner permitting said sheet material to be continuously moved through said plain die fold multiplier between a front end and a back end thereof;

a guide section proximate said front end for aligning and guiding each fold of said sheet material into said plain die fold multiplier: and a fold section for receiving said sheet material from said guide section, said fold section being configured for further folding said sheet material to double the number of folds to 2x while halving the height of each fold to y/2;

(d) causing said sheet material after a penultimate pair of rollers to enter into a front end of said plain die fold multiplier for entry into said guide section, with each fold being nestled between intermeshing downwardly and upwardly projecting triangular guide members, respectively, formed in top and bottom overlying sections of said plain die fold multiplier; and (e) moving said sheet material from said guide members into said fold section of said plain die fold multiplier, wherein each fold is passed between a pair of downwardly projecting adjacent triangular segments of said top section intermeshed with two adjacent triangular shaped depressions formed in said bottom section, whereby top edges of each fold in said sheet material are forced downward into said two adjacent triangular shaped depressions, thereby causing each original fold to be divided into two folds each having one-half the height of the associated original fold.

21. The method for folding in accordance with claim 20, wherein said step (b) is further defined by causing the sheet material to travel through pairs of rollers each with two more tessellations than each roller of a previous pair of rollers, and further comprising a step (f) of causing said sheet material to travel through a last pair of rollers, each roller in said last pair of rollers having a same number of tessellations as each roller of a penultimate pair of rollers.

22. The method of claim 20, further including the step(s) of:

successively repeating said moving step as said prefolded sheet material is moved through a plurality of said folding portions of said plain die fold multiplier until a desired number of folds and/or a desired fold height has been formed in said sheet material.

23. The method of claim 22, further including the step of: passing said sheet material through an exit region of said plain die fold multiplier whereby each fold is guided between a downwardly projecting triangular guide member from said top section of said plain die fold multiplier intermeshed with an upwardly projecting triangular guide member from said bottom section.

24. The method of claim 20, further including the step of: passing said sheet material through an exit region of said plain die fold multiplier whereby each fold is guided between a downwardly projecting triangular guide member from said top section of said plain die fold multiplier intermeshed with an upwardly projecting triangular guide member from said bottom section.

* * * * *